US011745060B2

(12) United States Patent
Greer et al.

(10) Patent No.: US 11,745,060 B2
(45) Date of Patent: Sep. 5, 2023

(54) GOLF CLUB HEAD WITH UNDERCUT AND INSERT

(71) Applicant: KARSTEN MANUFACTURING CORPORATION, Phoenix, AZ (US)

(72) Inventors: Evan Greer, Phoenix, AZ (US); Eric J. Morales, Laveen, AZ (US); Murphy R. Alexander, Scottsdale, AZ (US); Ryan M. Stokke, Anthem, AZ (US); Clayson C. Spackman, Scottsdale, AZ (US); Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/453,162

(22) Filed: Nov. 1, 2021

(65) Prior Publication Data

US 2022/0134195 A1 May 5, 2022

Related U.S. Application Data

(60) Provisional application No. 63/227,938, filed on Jul. 30, 2021, provisional application No. 63/108,226, filed on Oct. 30, 2020.

(51) Int. Cl.
*A63B 53/04* (2015.01)

(52) U.S. Cl.
CPC ..... *A63B 53/0425* (2020.08); *A63B 53/047* (2013.01); *A63B 53/0445* (2020.08); *A63B 53/0408* (2020.08)

(58) Field of Classification Search
CPC ..... A63B 53/0425; A63B 53/0445; A63B 53/047; A63B 53/0408
See application file for complete search history.

(56) References Cited

U.S. PATENT DOCUMENTS

| | | | | |
|---|---|---|---|---|
| 2,846,228 | A * | 8/1958 | Reach | A63B 53/047 473/332 |
| 4,667,963 | A | 5/1987 | Yoneyama | |
| 4,883,274 | A | 11/1989 | Hsien | |
| 4,928,972 | A * | 5/1990 | Nakanishi | A63B 53/047 473/332 |
| 4,964,640 | A | 10/1990 | Nakanishi et al. | |
| 5,290,036 | A * | 3/1994 | Fenton | A63B 53/04 273/DIG. 8 |
| 5,409,229 | A * | 4/1995 | Schmidt | A63B 53/04 473/332 |
| 5,588,923 | A * | 12/1996 | Schmidt | A63B 53/047 473/340 |
| 5,626,530 | A * | 5/1997 | Schmidt | A63B 53/047 473/332 |
| 6,045,456 | A | 4/2000 | Best | |
| 6,491,593 | B2 | 12/2002 | Takeda | |
| 6,592,469 | B2 | 7/2003 | Gilbert | |
| 6,835,144 | B2 | 12/2004 | Best | |
| 6,857,973 | B2 | 2/2005 | Wieland et al. | |

(Continued)

FOREIGN PATENT DOCUMENTS

TW 200738301 A 10/2007

*Primary Examiner* — William M Pierce

(57) ABSTRACT

The invention described herein is an iron-type golf club head having a back cavity and a multi-section back cavity insert that preserves more flexibility of the strike face and energy return to the golf ball.

20 Claims, 11 Drawing Sheets

(56) References Cited

U.S. PATENT DOCUMENTS 6,899,638 B2 5/2005 Iwata
6,902,495 B2 6/2005 Pergande et al.
6,942,580 B2 9/2005 Hou et al.
7,125,343 B2 10/2006 Imamoto
7,220,189 B2 5/2007 Wieland et al.
7,244,188 B2 7/2007 Best
7,473,190 B2 1/2009 Hocknell et al.
7,481,718 B2 1/2009 Soracco
7,731,604 B2 6/2010 Wahl et al.
7,789,771 B2 9/2010 Park
7,803,068 B2 9/2010 Clausen et al.
7,854,665 B2 12/2010 Dewhurst
7,892,106 B2 * 2/2011 Matsunaga ..... A63B 53/047 473/290
8,057,322 B2 11/2011 Wallans
8,282,506 B1 10/2012 Holt
8,333,667 B2 * 12/2012 Kumamoto ..... A63B 53/04 473/342
8,491,412 B2 7/2013 Roach et al.
8,632,421 B2 1/2014 Park et al.
8,753,220 B2 6/2014 Roach et al.
8,808,109 B2 8/2014 Roach
8,834,292 B2 9/2014 Tsuji et al.
8,864,603 B2 * 10/2014 Kumamoto ..... A63B 53/06 473/332
8,920,261 B2 * 12/2014 Taylor ..... B23P 11/02 473/350
8,951,141 B2 2/2015 Mizutani
9,039,543 B2 * 5/2015 Mizutani ..... A63B 60/54 473/332
9,393,469 B2 7/2016 Shimahara
9,517,393 B2 12/2016 Cardani et al.
9,533,200 B2 1/2017 Dolezel et al.
9,586,104 B2 3/2017 Roach
9,623,298 B2 4/2017 Ban
9,675,852 B2 6/2017 Westrum
9,873,028 B2 1/2018 Franklin
9,901,788 B2 2/2018 Franklin et al.
9,950,397 B2 4/2018 Taylor
9,975,016 B2 5/2018 Nakamura et al.
9,993,704 B2 6/2018 Hebreo
10,039,965 B1 8/2018 Seluga
10,112,084 B2 10/2018 Stokke et al.
10,335,652 B2 7/2019 Wallans
10,350,714 B2 7/2019 Taylor et al.
10,357,693 B2 7/2019 Franklin
10,357,696 B2 * 7/2019 Doi ..... A63B 53/047
10,427,018 B2 10/2019 Taylor
10,449,428 B2 10/2019 Parsons et al.
10,716,979 B2 7/2020 Hosooka
10,737,152 B2 8/2020 Seluga et al.
10,792,541 B2 * 10/2020 Cardani ..... A63B 53/047
10,821,338 B2 11/2020 Hebreo et al.
10,821,344 B2 11/2020 Mata
10,905,920 B2 * 2/2021 Parsons ..... A63B 60/02
2005/0130765 A1 6/2005 Wieland
2005/0181888 A1 9/2005 Hou
2007/0135233 A1 6/2007 Perras
2009/0131198 A1 5/2009 Wallans
2009/0247314 A1 * 10/2009 Matsunaga ..... A63B 53/047 473/291
2012/0252600 A1 10/2012 Tsuji
2014/0171220 A1 * 6/2014 Taylor ..... A63B 53/047 29/525
2016/0332043 A1 12/2016 Cardani
2017/0173410 A1 6/2017 Nakamura
2018/0185716 A1 * 7/2018 Doi ..... A63B 53/047

* cited by examiner

GOLF CLUB HEAD WITH UNDERCUT AND INSERT

This claims priority benefit from U.S. Provisional Application No. 63/108,226 filed Oct. 30, 2020, and claims priority benefit from U.S. Provisional Application No. 63/227,938 filed Jul. 30, 2021, all of which are fully incorporated herein by reference.

TECHNICAL FIELD

This disclosure generally relates to an iron-type golf club head with a back cavity and a back cavity insert.

BACKGROUND

It is common to affix inserts to the rear surface of an iron-type golf club head strikeface. Typical inserts affixed to the rear surface of the iron golf club head strikeface have continuous hard plastic or metallic covers comprising a single piece. When the golf club strikes a golf ball, the flex of the strikeface also attempts to move the insert rearward and to flex the insert affixed to the strikeface rear surface. Further, the designer may desire to thin the iron-type golf club head strikeface to both move more mass to the perimeter and also allow greater strikeface flexibility. In this iron-type golf club head design (having a thinner strikeface), a back cavity insert attached to the strikeface rear surface may have a greater effect on strikeface flexion. A single-piece hard plastic or metallic insert cover is put into tension as the insert flexes rearwards. This tension on the insert cover inhibits the rearward flexure of the insert. This inhibition of the flexing reduces the energy returned to the golf ball and reduces the distance the golf ball will travel after being struck. There is a need in the art for an iron-type golf club head with improved flexibility of a back cavity insert. The strikeface is then able to return more energy to the golf ball at impact if the back cavity flexion is improved, reducing the energy lost due to the insert's resistance to the strikeface flexing. Disclosed within is a back cavity insert with features to improve insert flexibility.

Figure 1:
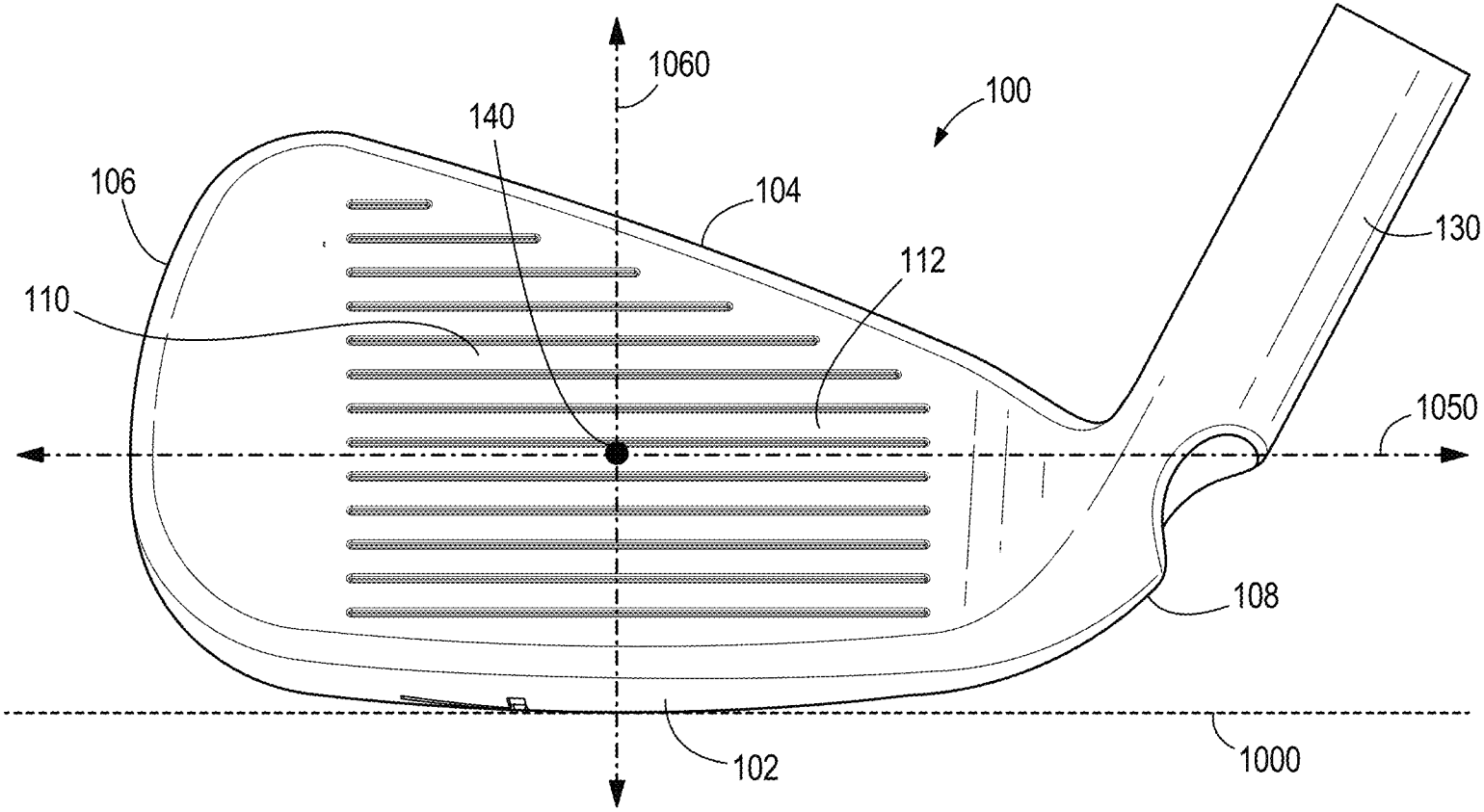
FIG. 1 illustrates a front view of an iron-type golf club head.
Figure 2:
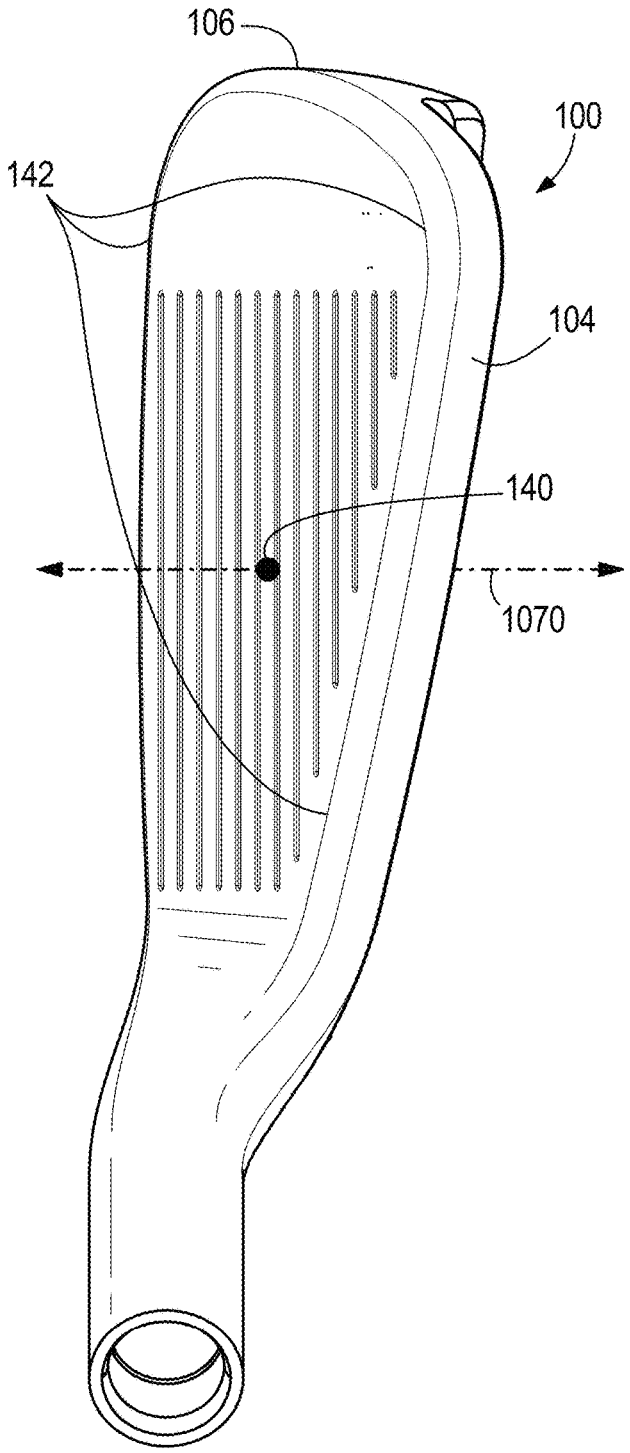
FIG. 2 illustrates a top view of the golf iron-type club head of FIG. 1.
Figure 3:
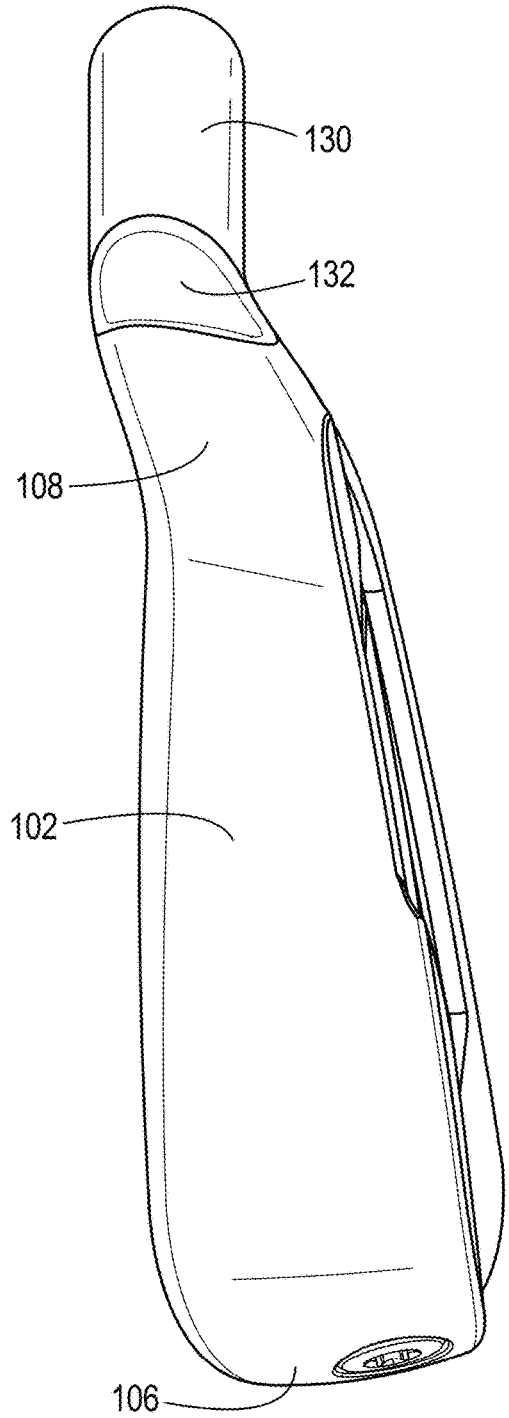
FIG. 3 illustrates a bottom view of the golf iron-type club head of FIG. 1.
Figure 4:
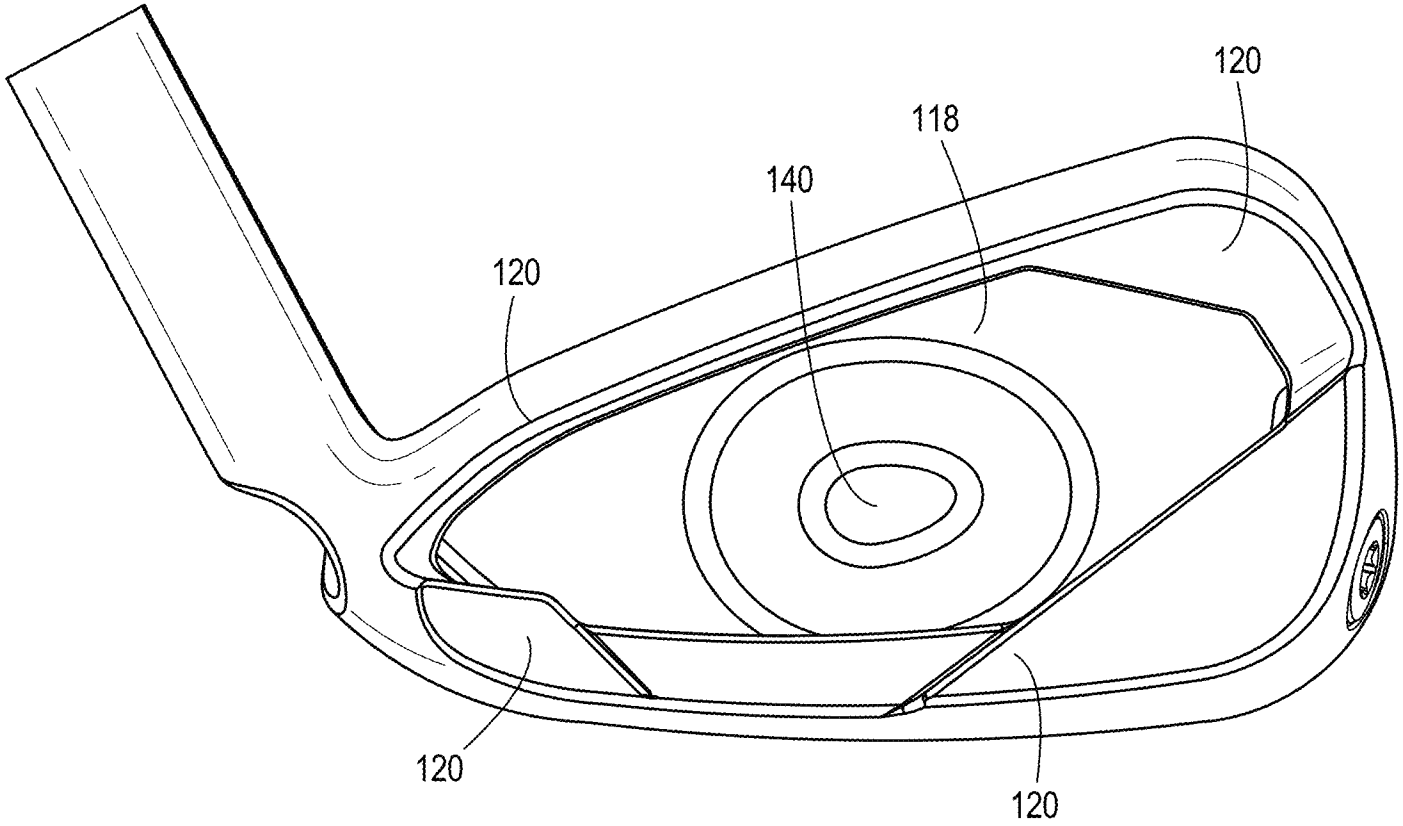
FIG. 4 illustrates a rear view of the golf iron-type club head of FIG. 1.

Other aspects of the disclosure will become apparent by consideration of the detailed description and accompanying drawings.

DETAILED DESCRIPTION

The invention presented herein is directed to a back cavity insert for a cavity-backed iron-type golf club head. The rear perimeter of the iron-type golf club head and the rear surface of a strikeface cooperate to define a back cavity. The rear perimeter can comprise any edge or percentage of the perimeter of the back cavity. An insert may be placed into the back cavity such that the insert covers at least 60 percent to 100 percent of the strikeface rear surface area. When the insert is attached to the iron-type golf club head strikeface rear surface, it will interact with the iron-type golf club head strikeface when the strikeface deforms and rebounds. The insert thickness, composition, and stiffened outer surface may unduly restrain the deformation or flexing of the strikeface and reduce the amount of energy returned to the golf ball. Disclosed herein is a back cavity insert comprising a multiple layers, wherein one or more of the the back cavity insert layers are divided into discrete sections. The division provides expansion and flexing gaps for the insert. The iron-type golf club head with a back cavity insert disclosed herein provides an insert that reduces the amount of energy lost to the back cavity insert when striking a golf ball. This, in turn, provides for more energy returned to the golf ball and desirable flight characteristics (lower ball spin rate, higher launch angle, and higher ball speed) resulting in more distance for each golf stroke.

I. Definitions

A. General Terminology

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

B. Coordinate System

A coordinate system may be defined as an x-axis 1050 defined in a direction parallel to a ground plane 1000. The iron-type golf club head 100 defines a ground plane 1000 that is tangent to the sole 102 when the iron-type golf club head 100 is at an address position. The x-axis 1050 passes through the strikeface geometric center 140 from the heel portion 108 to the toe portion 106. A y-axis 1060 is defined as passing through the strikeface geometric center 140, perpendicular to the x-axis 1050 from the sole 102 towards the top portion 104. A z-axis 1070 is defined perpendicular to both the x-axis 1050 and the y-axis 1060, passing through the strikeface geometric center 140 from a strikeface 110 front surface 112 rearward through the strikeface rear surface 118.

II. Iron-Type Golf Club Head Structure

The iron-type golf club head body comprises a top portion, a sole portion, a heel portion, a toe portion, a front portion further comprising a strikeface, and a back portion. The iron-type golf club head body further comprises a rear perimeter extension, extending rearward of a strikeface perimeter. The top portion extends rearwardly from the upper portion of the strikeface to form the rear perimeter extension top portion. The sole portion extends rearwardly from the lower portion of the strike face to form the rear perimeter extension sole portion. The heel portion extends rearwardly from the heel portion of the strike face to form a rear perimeter extension heel portion of the iron-type golf club head. The toe portion extends rearwardly from the toe portion of the strike face to form the rear perimeter extension toe portion. The rear perimeter extension and strikeface rear surface define an external rear cavity (on at least the rear surface). In many embodiments, an undercut recess circumscribes the external rear cavity, thereby forming a continuous or 360-degree undercut. In other embodiments, the undercut recess encompasses only a portion of the external rear cavity.

Referring to FIGS. 1-4, the iron-type golf club head 100 can comprise a iron-type golf club head body 100 with a back cavity 116 and an insert 200 received within the back cavity 116. The iron-type golf club head 100 can comprise a front portion 112 and a back portion 114, a strikeface comprising a strikeface front surface 117 located at the front portion 112, and a strikeface rear surface 118 located opposite the strikeface front surface 117 towards the back portion 114. The strikeface 110 can further comprise a strikeface geometric center 140, a strikeface perimeter 142. The iron-type golf club head 100 comprises a rear perimeter extension 121 extending rearward from the strike face perimeter 142. The strike comprises a strikeface thickness 144 measured from the strikeface front surface 117 to the strikeface rear surface 118. The iron-type golf club head 100 back cavity 116 is defined by an inner surface of the strikeface perimeter 142, and the strike face rear surface 118.

Still referring to FIGS. 1-4, the iron-type golf club head 100 can further comprise a top portion 104 and a sole 102; the top portion 104 having an arcuate top rail top portion and a top rail rear wall extending toward the bottom end to form a top rail wall. The top portion 104 further can comprise a top portion outer surface and a top portion inner surface such that a top rail rear wall inner surface is substantially parallel to and offset rearwardly from the strikeface rear surface. The iron-type golf club head 100 can comprise a bottom portion 101 having a sole 102 and a back portion 114 that is integrally formed with the sole 102. The back portion 114 can extend upward toward the top portion 104. The sole 102 can comprise a sole inner surface and a sole outer surface. The back portion 114 can comprise a back portion outer surface and a back portion inner surface. The back portion inner surface can be offset rearwardly from the strikeface rear surface 118.

The iron-type golf club head comprises a face height 122 measured between a topmost edge of the top portion 104 and a bottommost edge of the sole 102. In many embodiments, the face height 122 can be measured as a maximum distance between a top rail edge and a sole edge leading edge. The face height 122 is measured parallel to the loft plane 1010 tangent to the strikeface 110 at the strikeface geometric center 140, between the topmost edge of the top portion 104 and the bottommost edge of the sole 102. The face height 122 can range from 1.4 inches to 2.2 inches. In other embodiments, the face height can range from 1.4 inches to 1.8 inches or 1.8 inches to 2.2 inches. In other embodiments still, the face height can range from 1.4 inches to 1.9 inches, 1.5 inches to 2.0 inches, 1.6 inches to 2.1 inches, or 1.7 inches to 2.2 inches. For example, the face height 122 can be 1.4 inches, 1.5 inches, 1.6 inches, 1.7 inches, 1.8 inches, 1.9 inches, 2.0 inches, 2.1 inches, or 2.2 inch inches.

The strikeface 110 comprises a measured from the strikeface front surface 117 to the strikeface rear surface 118 in a direction perpendicular to the loft plane 1010 or the strikeface front surface 117. The multi-component insert 200 allows the strikeface 110 to be thinner compared to iron, devoid of the multi-component insert. The insert 200 further reinforces the strikeface 110 and allows the strikeface thickness to be reduced. In many embodiments, the strikeface 110 comprises a variable face thickness with a maximum thickness positioned near the strikeface geometric center 140 and a minimum thickness positioned near the strikeface perimeter 142. The strikeface thickness can range from 0.065 to 0.14 inch. In other embodiments, the strikeface thickness can range from 0.065 to 0.12 inch, 0.07 to 0.13 inch, or 0.075 to 0.14 inch. For example, the strikeface thickness can be 0.065, 0.07, 0.075, 0.08, 0.085, 0.09, 0.10, 0.11, 0.12, 0.13, or 0.14 inch. For example, the strikeface thickness near the geometric strikeface center 140 can range from 0.10 to 0.13 inch, and the strikeface thickness near the strikeface perimeter 142 can range from 0.065 to 0.095 inch. A strikeface thickness of an iron-type club head 100 devoid of the multi-component insert can require a strikeface thickness above 0.14 inch and a strikeface perimeter thickness above 0.10 inch to have sufficient durability and proper flexural response. When the strikeface thickness is in the lower portions of this range, the strikeface will flex more under impact. A back cavity insert adhered to the strikeface rear surface (as discussed herein below) will affect the flexure of the strikeface for any strikeface thickness, but more so as the strikeface thickness decreases.

The aspects of the iron-type golf club 100 described herein may be applied to one or more golf clubs within a set of irons. In some embodiments, the set of irons comprises irons having varying clubhead size, shaft length, lie angle, loft angle, head weight, and/or other parameters. Each clubhead in the set of irons can be numbered according to the convention, with numbers ranging from 1 to 10. Most commonly, a set is numbered from 2 to 9, wedge, and utility clubs. Furthermore, the set of irons can comprise one or more wedges, which have a loft angle higher than the numbered irons.

Figure 9:
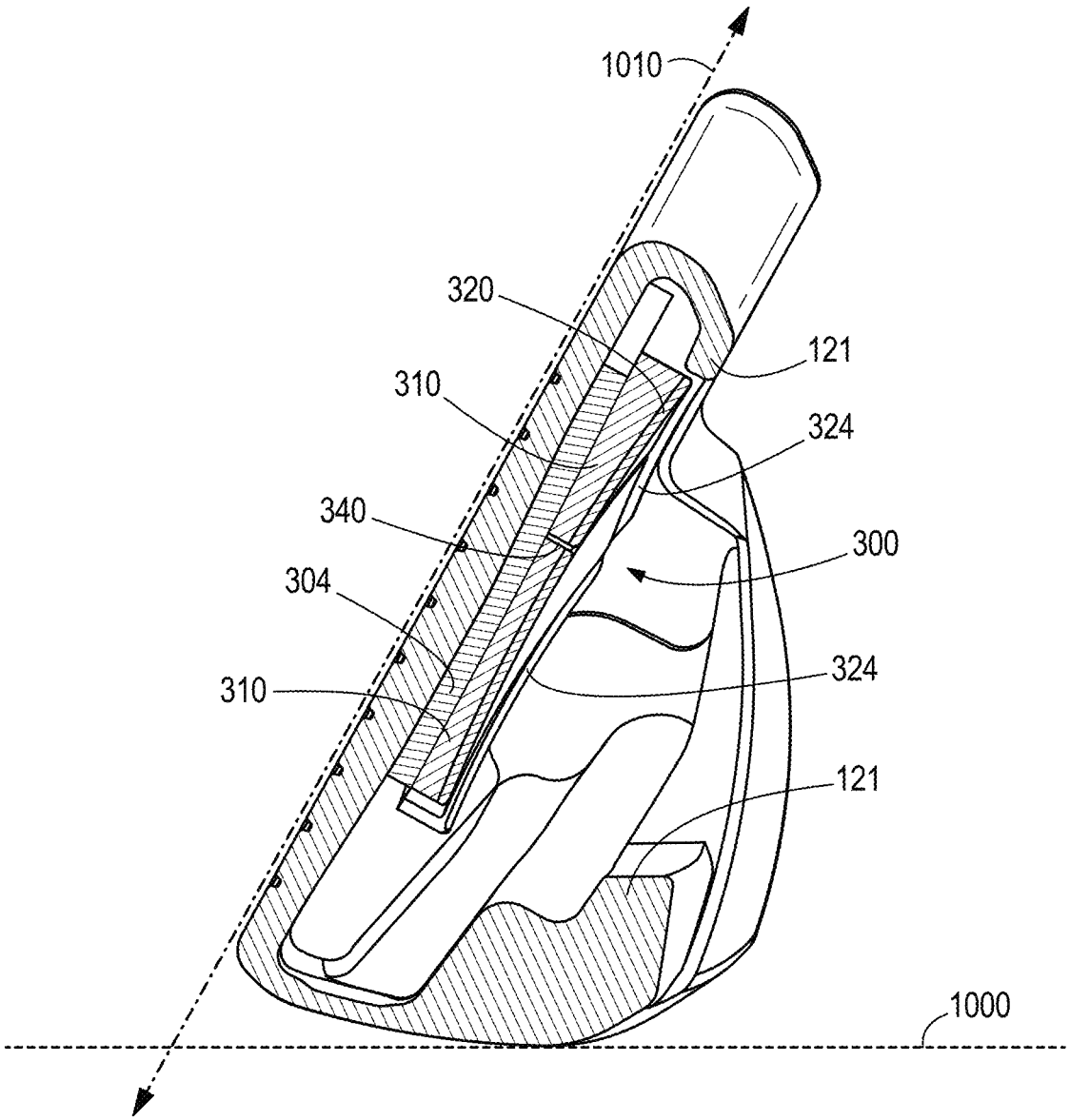
FIG. 9 illustrates a cross-section of an insert received within the back cavity of an iron-type golf club head.
Figure 10:
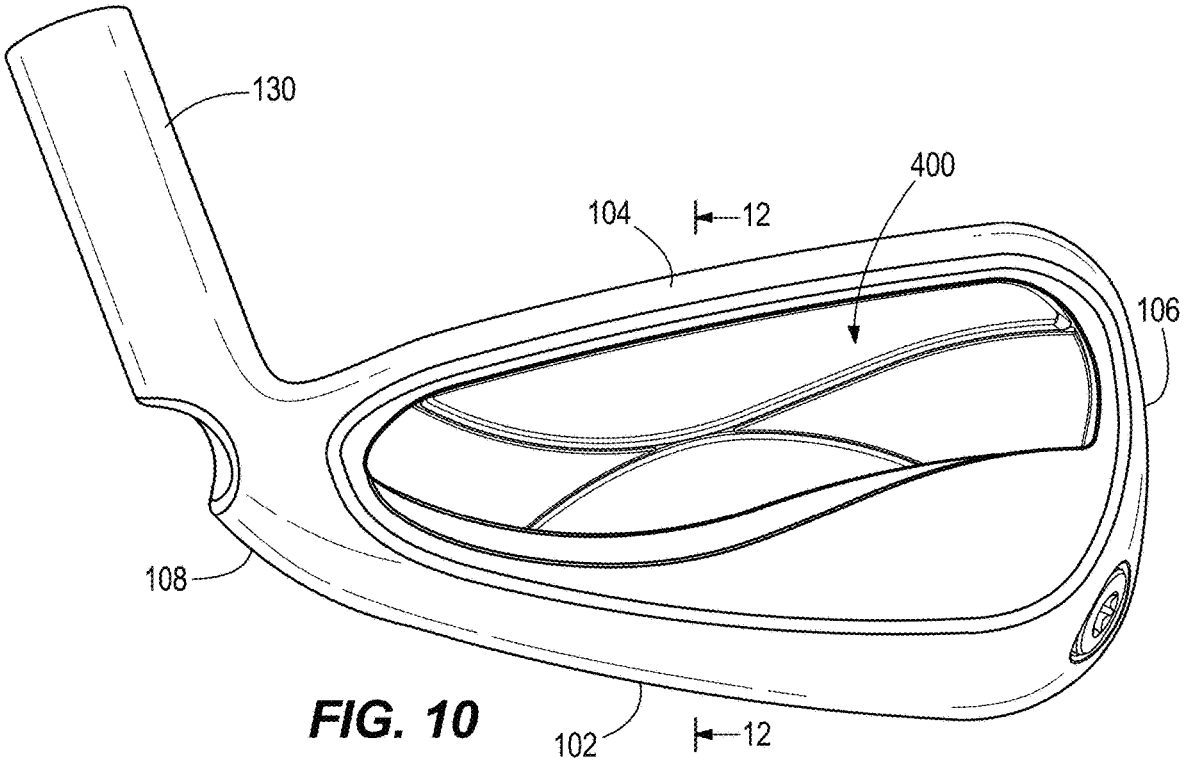
FIG. 10 illustrates an embodiment of an insert received in a back cavity of an iron-type golf club head.
Figure 11:
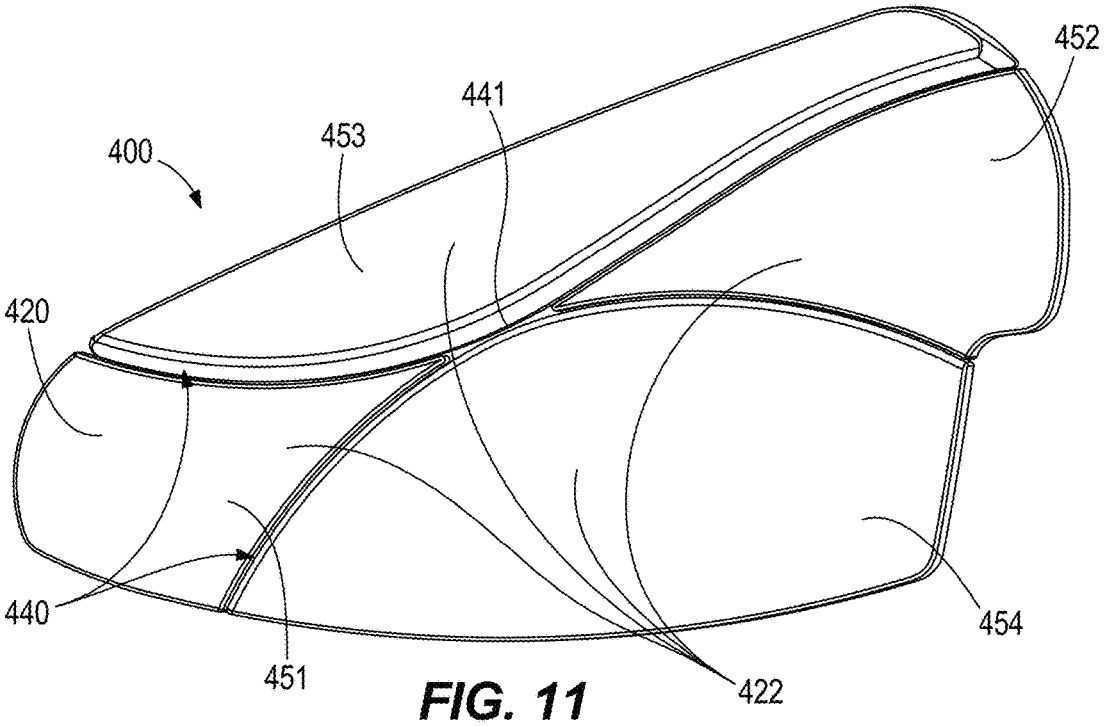
FIG. 11 illustrates one embodiment of an insert.
Figure 12:
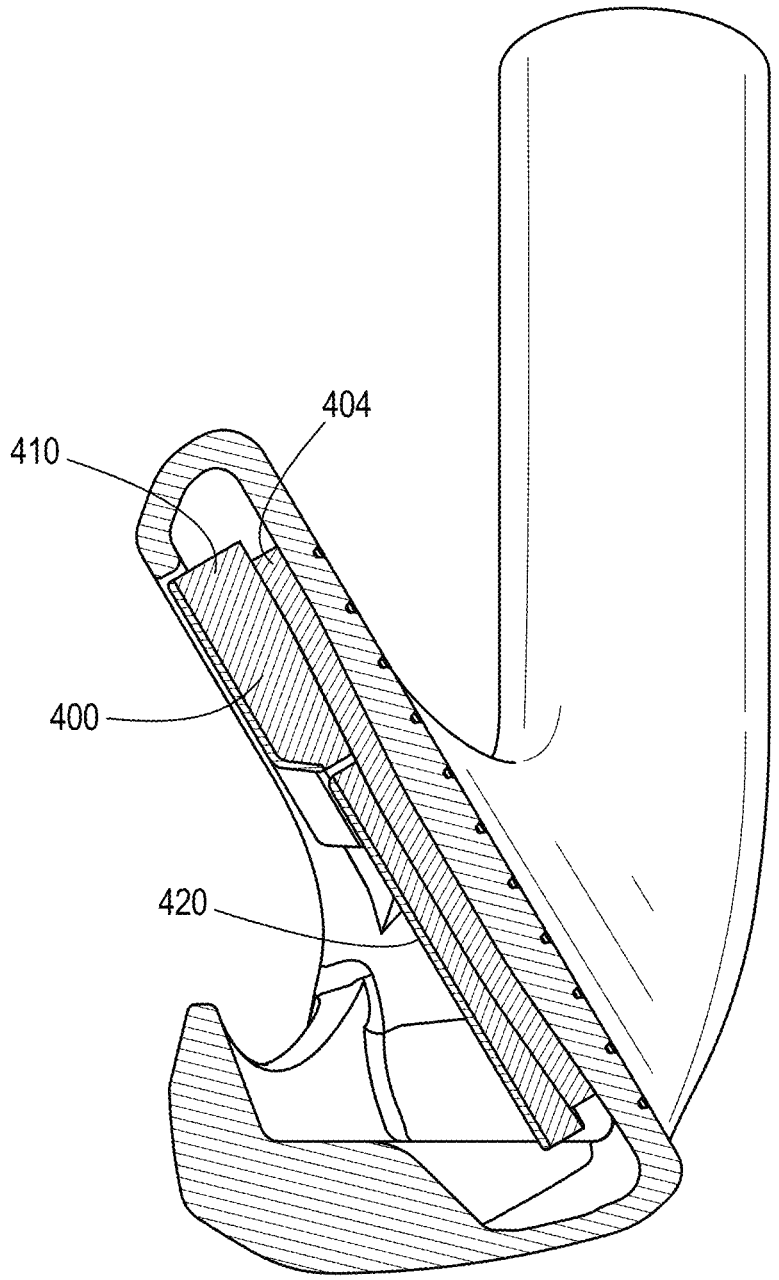
FIG. 12 illustrates a cross-section of an insert received within the back cavity of an iron-type golf club head.
Figure 13:
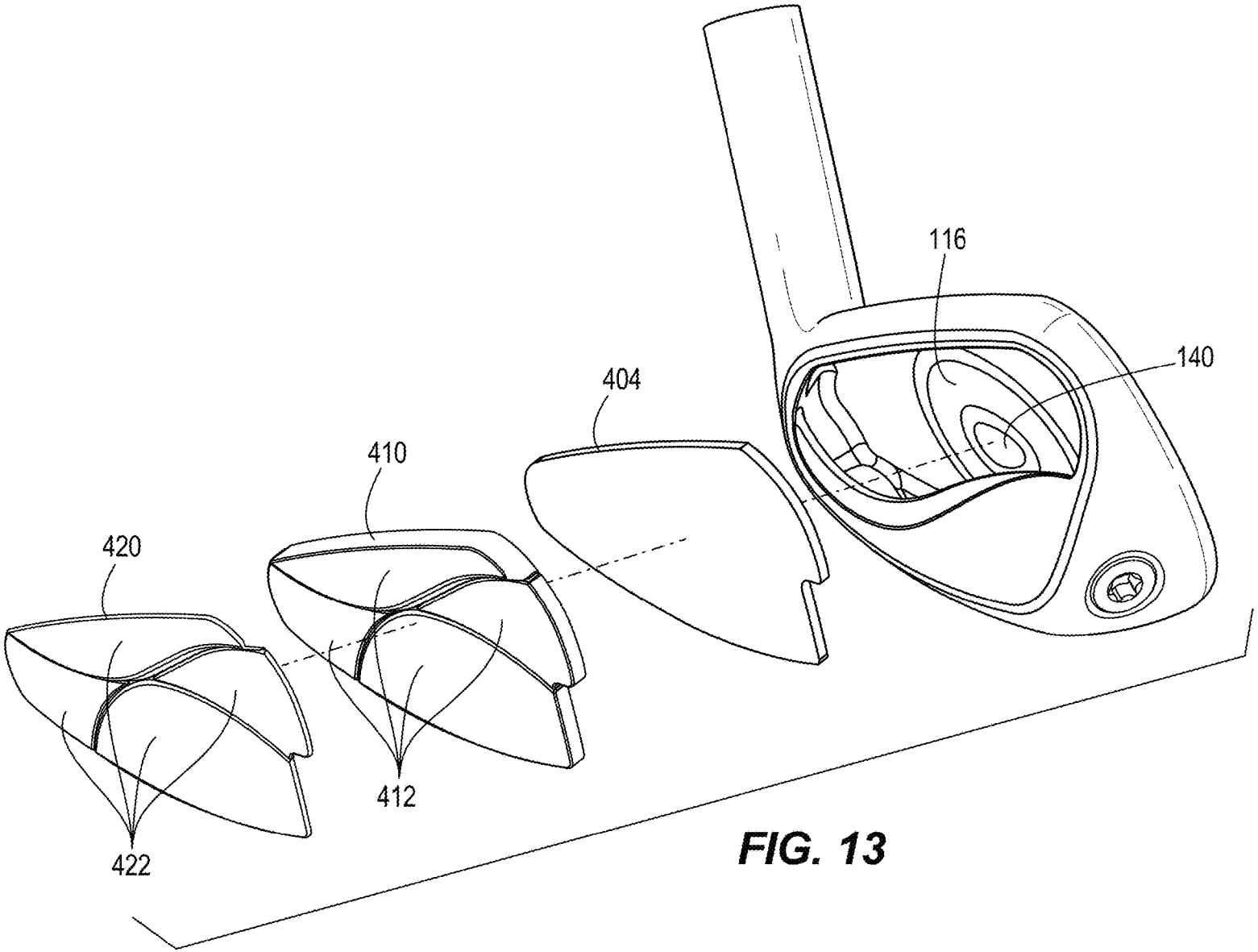
FIG. 13 illustrates an exploded view of an embodiment of an insert.

Referring to FIG. 9, a loft angle is defined as the angle between the ground plan 1000 and the loft plane 1010. In many embodiments, the iron-type golf club head 100 comprises a loft angle less than approximately 64 degrees, less than approximately 63 degrees less than approximately, less than approximately 62 degrees, less than approximately 61 degrees, less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

The volume of the iron-type golf club head 100 described herein comprises a volume of between 1.9 cubic inches and 2.7 cubic inches. In some embodiments, the total volume of the iron-type golf club head 100 can be between 1.9 cubic inches and 2.4 cubic inches, 2.0 cubic inches and 2.5 cubic inches, 2.1 cubic inches and 2.6 cubic inches, 2.2 cubic inches and 2.7 cubic inches, 2.3 cubic inches, and 2.7 cubic inches, or 2.4 cubic inches and 2.7 cubic inches. In other embodiments, the total volume of the iron-type golf club head 100 can be 1.9 cubic inches, 2.0 cubic inches, 2.1 cubic inches, 2.2 cubic inches, 2.3 cubic inches, 2.4 cubic inches, 2.5 cubic inches, 2.6 cubic inches, or 2.7 cubic inches.

The mass of the iron-type golf club head 100 described herein comprises a total mass of between 200 grams and 300 grams. In some embodiments, the iron-type golf club head 100 can comprise a total mass of between 200 grams and 210 grams, 210 grams and 220 grams, 220 grams and 230 grams, 230 grams and 240 grams, 240 grams and 250 grams, 250 grams, and 260 grams, 255 grams and 260 grams, 260 grams to 270 grams, 265 grams to 275 grams, 270 grams and 280 grams, 275 grams, and 280 grams, or 250 grams and 270 grams. In other embodiments, the total mass can be 200 grams, 205 grams, 210 grams, 220 grams, 225 grams, 230 grams, 235 grams, 240 grams, 245 grams, 250 grams, 255 grams, 260 grams, 265 grams, 270 grams, 275 grams, 280 grams, 285 grams, 290 grams, 295 grams, or 300 grams.

Referring to FIGS. 1-4, the iron-type club head 100 includes a strike face 110 for contacting a golf ball. The iron-type golf club head body further includes a hosel 130 for receiving a shaft (not shown). The multi-material iron-type golf club head body 100 described herein can be constructed from any material used to construct a conventional iron-type golf club head. For example, the material of the golf club head body 100 can be constructed from any one or combination of the following: 8620 alloy steel, S25C steel, carbon steel, maraging steel, 17-4 stainless steel, 1380 stainless steel, 303 stainless steel, stainless steel alloys, tungsten, aluminum, aluminum alloys, ADC-12, titanium, titanium alloys, or any metal for creating an iron-type golf club head.

III. Back Cavity Insert

1. General Insert Structure

The iron-type golf club head 100 can further comprise a back cavity insert 200 adhesively attached to a strikeface rear surface. In one embodiment, a multi-material back cavity insert 200 can be formed from an elastomeric material, plastic, and/or aluminum. In other embodiments, the back cavity insert 200 can be formed solely of an elastomeric material or other flexible polymeric materials. In still other embodiments, the back cavity insert 200 can be formed from an adhesive layer and a stiffening cap. The structure of the back cavity insert 200 may comprise two or more layers comprising different materials permanently affixed one to another.

The back cavity insert may cover 100 percent of the strikeface rear surface. The back cavity insert may cover less than 100 percent of the strikeface rear surface. The back cavity insert may cover between 60 percent and 100 percent of the strikeface rear surface. The back cavity insert may cover 60 percent, 65 percent, 70 percent, 75 percent, 80 percent, 85 percent, 90 percent, 95 percent, or 100 percent of the strikeface rear surface.

Figure 5A:
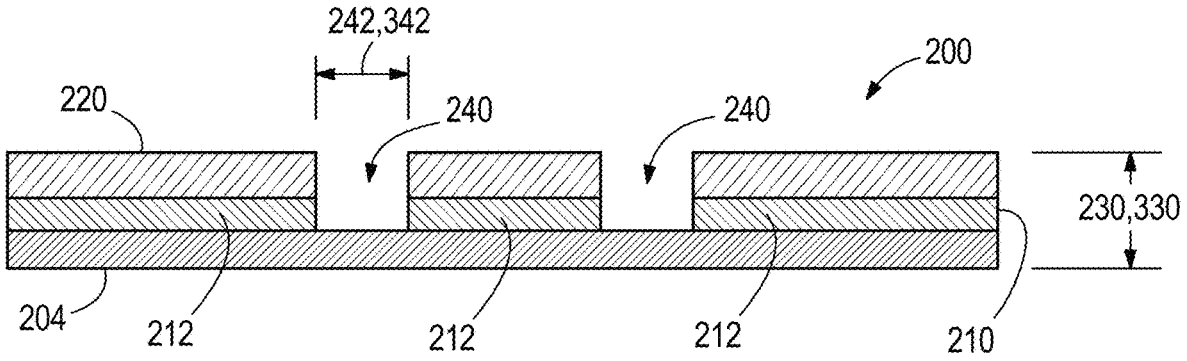
FIG. 5A illustrates a cross-sectional view of an insert embodiment.
Figure 5B:
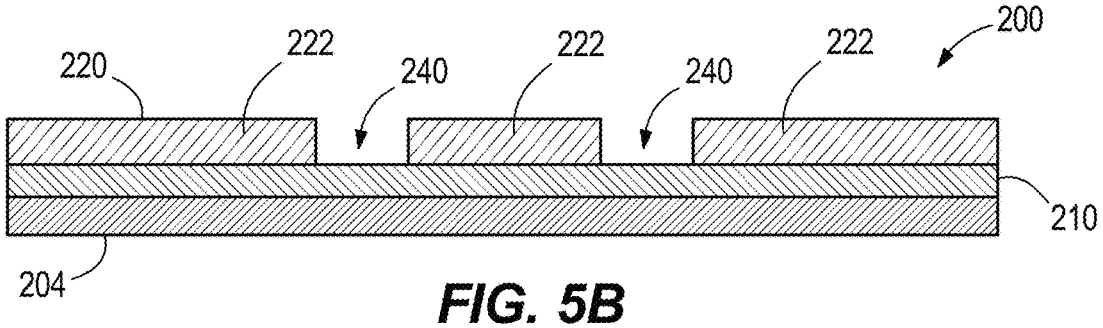
FIG. 5B illustrates a cross-sectional view of an insert embodiment.
Figure 5C:
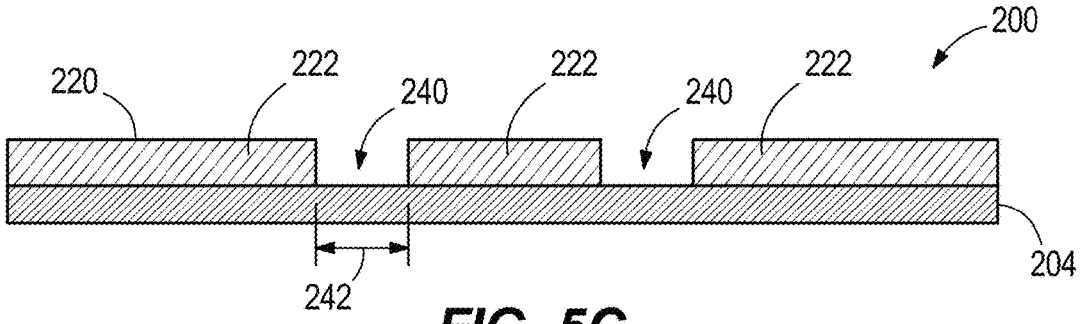
FIG. 5C illustrates a cross-sectional view of an insert embodiment.
Figure 6:
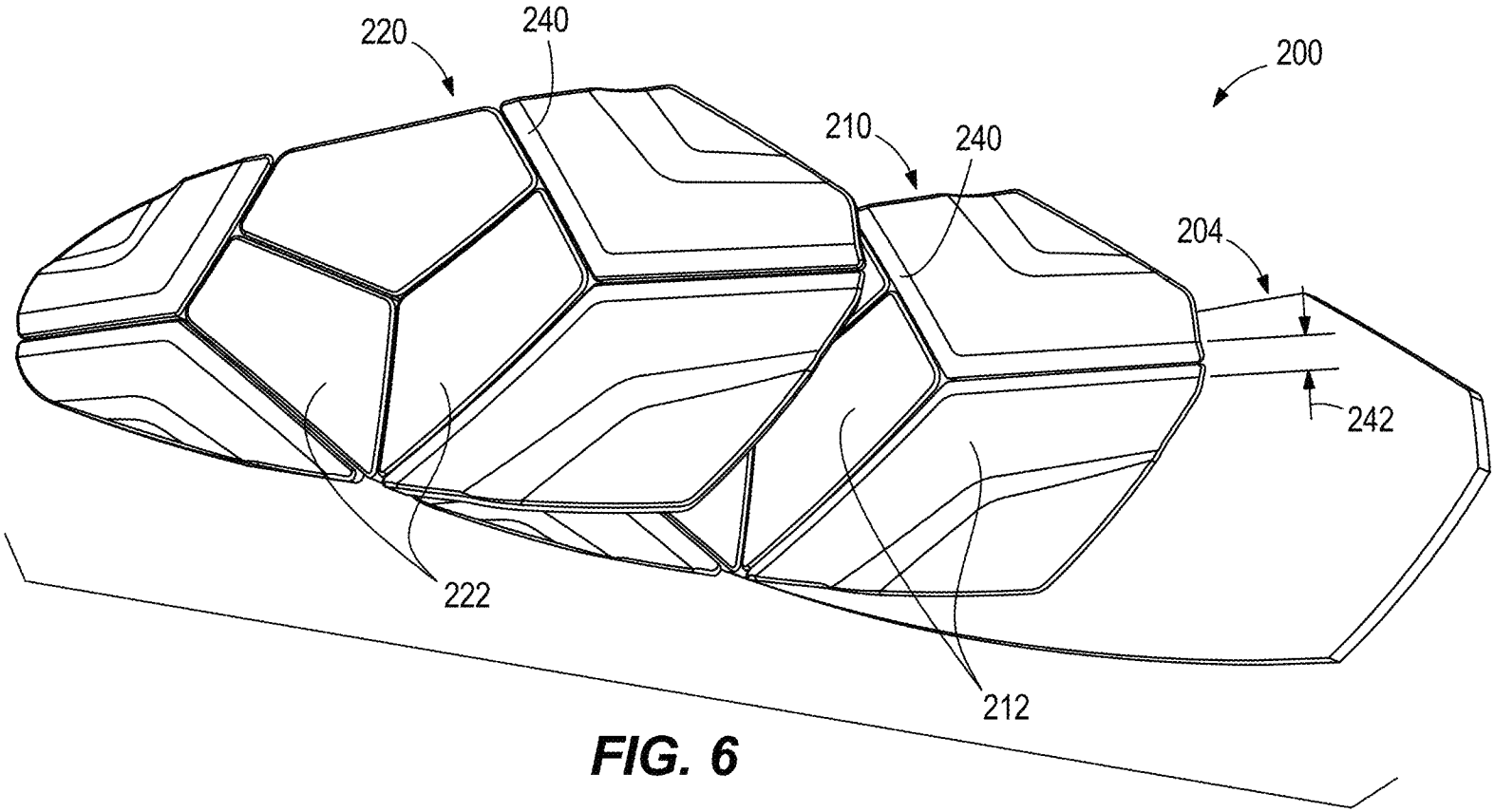
FIG. 6 illustrates an exploded view of an insert embodiment.
Figure 7:
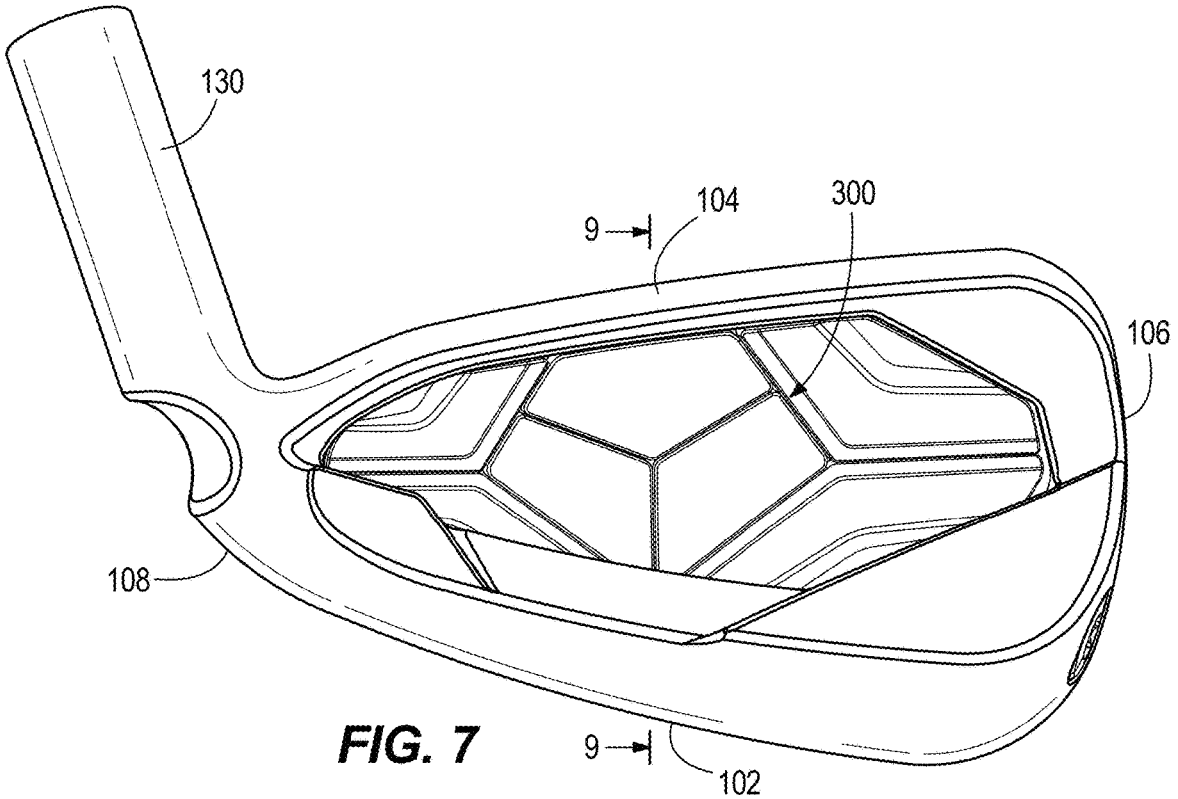
FIG. 7 illustrates an embodiment of an insert received in a back cavity of the golf iron-type club head of FIG. 1.
Figure 8:
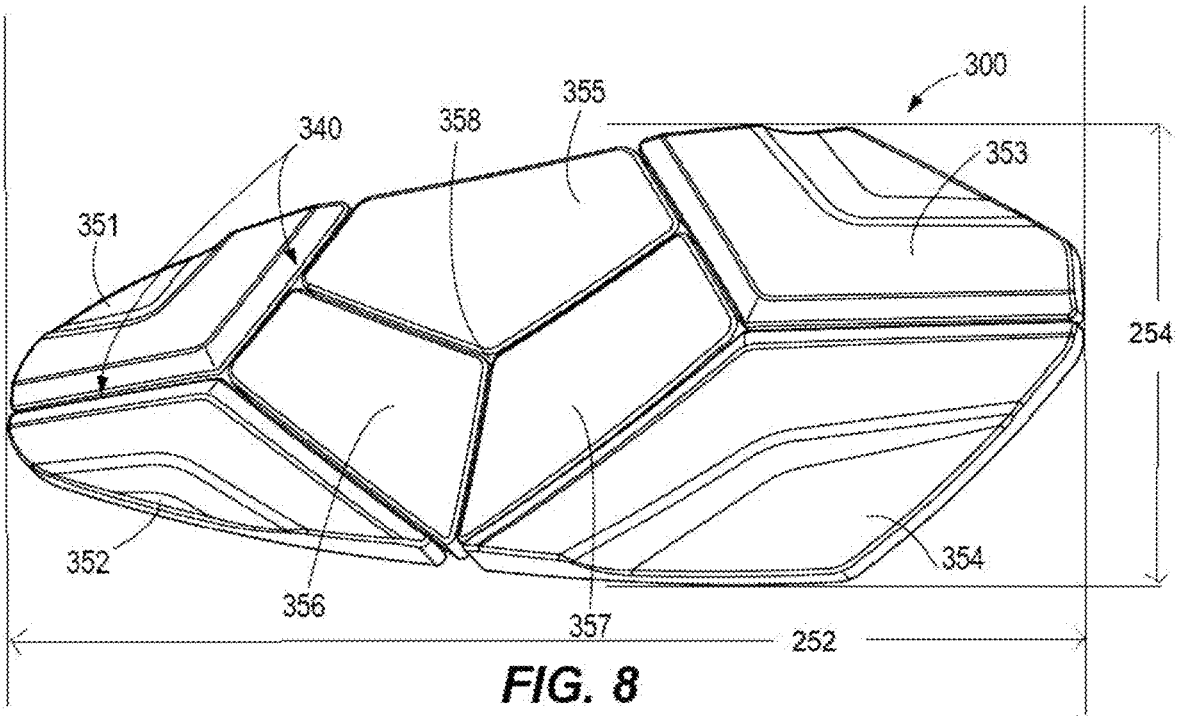
FIG. 8 illustrates an embodiment of an insert.

Referring to FIGS. 5A-6, the insert 200 can comprise up to three layers wherein up to two layers are separated into portions forming multiple insert sections 224. The three layers are the adhesive layer 204, the elastomeric layer 210, and the cap 220. In one embodiment, the adhesive layer 204 is a single, continuous piece that is unitary and without divisions. In all embodiments of the insert 200 disclosed herein, the adhesive is not separated into portions or sections. As explained here and below, the separation of one or more other layers of the insert 200 into a plurality of multiple sections enables better insert flexural response when the strikeface deforms under impact with a golf ball. Embodiments of the insert 200 comprising a plurality of individual sections 224 may comprise between 3 and 12 sections. The insert may comprise 3, 4, 5, 6, 7, 8, 9, 10, 11, or 12 individual sections 224.

In one embodiment, the elastomeric layer 210 and the cap 220 are configured to form a plurality of discontinuous insert sections 224. The elastomeric layer 210 is discontinuous, comprising a plurality of elastomeric layer portions 212. The cap 220 is discontinuous, comprising a plurality cap portions 222. Each one of the plurality of elastomeric layer portions 212 is bonded with a single one of the plurality of cap portions 222 to form a plurality of insert sections 224. Each of the bonded elastomeric layer portions 212 is shaped congruently to each of the cap portions 222 to which it is bonded. Each insert section 224 comprising an elastomeric portion 212 and a cap portion 222 is affixed to the adhesive layer 204 such that the elastomeric portion 212 is entirely affixed to the adhesive layer 204. The plurality of insert sections are not continuous. The insert sections 224 are positioned on the adhesive layer 204 such that the outer edges of any one insert section do not directly abut the outer edges of any adjacent insert sections. The adhesive layer 204 is not completely covered by the insert sections 224; instead, the insert sections 224 are separated by gaps 240 between the spaced-apart, outside edges of the insert sections defined by the uncovered areas of the adhesive layer 204. As explained further below, the gaps 240 provide increased insert flexibility and, in turn, allows more energy to be returned to the golf ball when struck by the golf club.

Referring to FIG. 5C, in a different embodiment, the insert comprises multiple insert sections 224 as described above, but each of the plurality of insert sections 224 consists of only a single cap portion 222, having no elastomeric portion 212 between the adhesive layer 204 and the cap portions 222. The adhesive layer 204 is, again, a single continuous piece. However, in this embodiment, the insert sections 224 consists only of the cap portions 222 attached directly to the adhesive layer 204. Again, the adhesive layer 204 is not completely covered by the insert sections 224 (cap portions 222); instead, the insert sections 224 (cap portions 222) are separated by gaps 240 between the spaced-apart, outside edges of the insert sections (cap portions 222) defined by the uncovered areas of the adhesive layer 204.

Referring to FIG. 5B, in still another embodiment, the adhesive layer 204 is a single continuous piece, and the elastomeric layer 210 is also a single continuous piece congruent to and entirely covering the adhesive layer 204. In this embodiment, the elastomeric layer 210 is not divided into portions. In this embodiment, the insert comprises multiple insert sections 224 as described above, but each individual insert section 224 consists of only a single cap portion 222. In this embodiment, the adhesive layer is not exposed in the gaps 240 between the insert sections 224, as it is covered by the elastomeric layer. Instead, the continuous elastomeric layer 210 is exposed between the gaps 240, spacing the insert sections 224 from one another.

The adhesive layer 204 is applied to and adheres to the strikeface rear surface 118. When present, the elastomeric layer 210 abuts directly against and is attached to the adhesive layer 204. When present, the elastomeric layer 210, is located between the adhesive layer 204 and the cap 220. The insert cap 220 comprises an insert 200 outer surface. The cap 220 comprises the outermost, rearward layer of the insert 200, with an inner side adhering to the elastomeric layer 210. The cap 220 may function as a stiffener layer. The insert 200 further comprises an interior surface, wherein the insert interior surface comprises the exposed portion of adhesive layer 204 prior to the installation of the insert 200 into the back cavity 116.

The insert thickness 230 comprises the sum of the thicknesses for each of the one or more layers. The thickness may be constant for each of the one or more layers. The thickness may vary for each of the one or more layers. Referring to FIGS. 5A-6, the insert thickness 230 comprises the sum of the thicknesses of the adhesive layer 204, the elastomeric layer 210, and cap 220 together. The insert thickness 230 of any one of the plurality of insert sections 224 may be constant. The insert thickness 230 of any one of the plurality of insert sections 224 may vary. The insert thickness 230 may be the same for any two sections 224. The insert thickness 230 may differ between any two sections 224.

Referring to FIG. 5A, a total insert thickness 230 is measured between an exposed surface of the adhesive layer and the exposed surface of the outermost layer. The total insert thickness 230 can range between 0.033 inch and 0.620 inch. For example, in many embodiments, the total insert thickness 230 can be approximately 0.033 inch, 0.035 inch, 0.037 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, 0.150 inch, 0.160 inch, 0.170 inch, 0.180 inch, 0.190 inch, 0.200 inch, 0.210 inch, 0.220 inch, 0.230 inch, 0.240 inch, 0.250 inch, 0.260 inch, 0.270 inch, 0.280 inch, 0.290 inch, 0.300 inch, 0.310 inch, 0.320 inch, 0.330 inch, 0.340 inch, 0.350 inch, 0.360 inch, 0.370 inch, 0.380 inch, 0.390 inch, 0.400 inch, 0.410 inch, 0.420 inch, 0.430 inch, 0.440 inch, 0.450 inch, 0.460 inch, 0.470 inch, 0.480 inch, 0.490 inch, 0.500 inch, 0.510 inch, 0.520 inch, 0.530 inch, 0.540 inch, 0.550 inch, 0.560 inch, 0.570 inch, 0.580 inch, 0.590 inch, 0.600 inch, 0.610 inch, or 0.620 inch. The total insert thickness 230 can be constant. The total insert thickness 230 can vary.

The adhesive layer 204 may have an adhesive layer thickness in a range of 0.003 inch to 0.120 inch. The adhesive layer thickness may be 0.003 inch, 0.005 inch, 0.010 inch, 0.020 inch, 0.030 inch, 0.040 inch, 0.050 inch, 0.060 inch, 0.070 inch, 0.080 inch, 0.090 inch, 0.100 inch, 0.110 inch, or 0.120 inch. The elastomeric layer 210 may have an elastomeric layer thickness in a a range of 0.020 inch to 0.400 inch. The elastomeric layer thickness may be 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, 0.150 inch, 0.160 inch, 0.170 inch, 0.180 inch, 0.190 inch, 0.200 inch, 0.210 inch, 0.220 inch, 0.230 inch, 0.240 inch, 0.250 inch, 0.260 inch, 0.270 inch, 0.280 inch, 0.290 inch, 0.300 inch, 0.310 inch, 0.320 inch, 0.330 inch, 0.340 inch, 0.350 inch, 0.360 inch, 0.370 inch, 0.380 inch, 0.390 inch, or 0.400 inch. The cap 220 may have a cap thickness in a range of 0.010 inch to 0.100 inch. The cap 220 thickness may be 0.010 inch, 0.020 inch, 0.030 inch, 0.040 inch, 0.050 inch, 0.060 inch, 0.070 inch, 0.080 inch, 0.090 inch, or 0.100 inch.

The insert 200 comprises an insert top end, bottom end, toe end, heel end. The insert comprises a maximum insert length 252 measured from the most toeward point of the toe end to the most heelward point of the heel end. The insert comprises a maximum insert width 254 measured from the most topward portion of the insert top end to the most bottomward portion of the insert bottom end. The maximum insert length 252 may vary in a range of 2.5 inches to 3.2 inches. The maximum insert length may be 2.5 inches, 2.6 inches, 2.7 inches, 2.8 inches, 2.9 inches, 3.0 inches, 3.1 inches, or 3.2 inches. The maximum insert width 254 may vary in a range of 1.0 inch to 1.4 inches. The maximum insert width 254 may be 1.0 inch, 1.1 inches, 1.2 inches, 1.3 inches, or 1.4 inches.

2. General Insert Function

A typical insert having a single, continuous, unbroken outer layer, usually metallic, lacks the ability to fully conform to the changing shape of a strikeface flexing at impact. Instead, the outer layer of the insert is put into tension as it is pushed rearwards, resisting the rearward bowing of the strikeface to some degree. The disclosed insert reduces the flexural resistance of the insert 200. Referring to FIGS. 5A-5C, the insert 200 comprising multiple sections 224 is assembled with the iron-type golf club head by affixing the insert 200 to the rear surface of the strikeface 118. The strikeface 110 flexes rearward when the iron-type golf club head 100 strikes a golf ball. As the strikeface 110 flexes rearward, the adhesive layer 204 also flexes rearward, curving to match the rearward flexing of the strikeface 110. As the adhesive layer 204 flexes rearward at impact, the gaps 240 between individual insert sections 224 allow the insert sections 224 to spread apart (instead of being put into tension), increasing the gap width 242 between the individual insert sections. This, in turn, preserves the energy available to return to the golf ball upon the rebound of the strikeface 110. The insert 200 does not resist the flexing of the strikeface 110 to the same extent as an insert comprising a single piece cap or outer layer due to the gaps 240 between insert sections. As the strikeface 110 rebounds, the adhesive layer 204 returns to its flatter shape, and the individual compound panels or sections are returned to their original configuration, having lesser gaps between them.

Referring to FIGS. 5A-5C, the gaps 240 between the individual sections 224 prior to impact with a golf ball have a minimum or resting gap width 242 that ranges from 0.005 inch to 0.010 inch. The minimum gap width 242 may be 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021 inch, 0.022 inch, 0.023 inch, 0.024 inch, 0.025 inch, 0.026 inch, 0.027 inch, 0.028 inch, 0.029 inch, 0.030 inch, 0.031 inch, 0.032 inch, 0.033 inch, 0.034 inch, 0.035 inch, 0.036 inch, 0.037 inch, 0.038 inch, 0.039 inch, or 0.040 inch. The minimum gap width 242 is not less than 0.005 inch to prevent interference from outer edges of the individual sections 224. During the impact flexing of the strike face, the flexed or maximum width 244 of the gaps 240 between the individual compound panels may increase up to an additional 0.010 inch more than the resting, minimum gap width 242, depending on the location of the individual gap 240 on the insert 200. The maximum gap width 244 may be 0.015 inch, 0.016 inch, 0.017 inch, 0.018 inch, 0.019 inch, 0.020 inch, 0.021 inch, 0.022 inch, 0.023 inch, 0.024 inch, 0.025 inch, 0.026 inch, 0.027 inch, 0.028 inch, 0.029 inch, 0.030 inch, 0.031 inch, 0.032 inch, 0.033 inch, 0.034 inch, 0.035 inch, 0.036 inch, 0.037 inch, 0.038 inch, 0.039 inch, 0.040 inch, 0.041 inch, 0.042 inch, 0.043 inch, 0.044 inch, 0.045 inch, 0.046 inch, 0.047 inch, 0.048 inch, 0.049 inch, or 0.050 inch. The maximum gap width controls the particles size of dust, dirt, sand, or other material that might be entrapped in the gaps by sticking to the adhesive layer 204 surface. The larger the maximum gap width, the larger the size an entrapped particle could be. It is therefore preferred to control the maximum gap size to the above ranges to prevent larger particle entrapment. Gaps 240 between individual compound panels closer to the center of the strikeface rear surface 118 will increase in width to a larger extent than those further from the strikeface center 140 rear surface 118 because the strikeface flexes to a greater degree near the strikeface center when striking a golf ball. Again, the expansion of the gaps 240 reduces the flexural resistance of the insert 200, and allows more energy to be returned to the golf ball.

Referring to FIGS. 5A-5C, the flexing of an insert 200 facilitated by the gaps 240 between the individual insert sections 224 restrains the flexing of the strike face at impact to a lesser degree than an insert 200 comprising a single, continuous, unbroken outer surface layer. This allows more energy to be returned to the golf ball. More specifically, the lowered flexural resistance of insert 200 provides for a golf ball launch speed of 1 to 2 mph greater (assuming an 85 mph swing speed) with the multiple insert sections in comparison to the same iron-type golf club head with an insert comprising a single outer surface layer. In turn, the added golf ball launch speed will allow the golf ball to fly further—as much as 1-3 yards further. The benefit to the golfer is that an iron with a higher loft may be used, further allowing a higher arcing flight trajectory for the golf shot.

The iron-type golf club head strikeface 110 typically flexes the most near the geometric center 140. It is, therefore, advantageous for insert sections 224 to be arranged such that gaps between insert sections are on or very near the region of strikeface 110 directly surrounding the strikeface geometric center 140. It is advantageous for a plurality of insert sections 224 outer edges to be in a range of 0.1 inch to 0.5 inch of the strikeface geometric center. The plurality of insert section 224 outer edges can be 0.1 inch, 0.2 inch, 0.3 inch, 0.4 inch, or 0.5 inch from the strikeface geometric center for a more advantageous flexing effect. The insert sections 224 may be arranged in a variety of configurations. In some embodiments, polygonal insert sections can be arranged around the strikeface geometric center such that a vertex of each polygonal insert is on or near the geometric center 140. In other embodiments, longer edges of two or more insert sections of any shape may be positioned on or near the geometric center 140. Providing gapping at or near the geometric center 140 allows the insert 200 to expand at the area of greatest strikeface deformation under impact. The gaps 240 have a gap width 242 and a gap depth that is same as the thickness of the insert sections surrounding each of the gaps 240. Because the flexure of the strikeface 110 at impact is in three dimensions, the flexure of the back cavity insert attached to the strikeface rear surface is also three dimensional. As a result, the rearward flexion of the badge extends the gap width more at the outer surface of the back cavity insert than it does at the surface of the adhesive layer 204. The gaps 240 must, therefore, spread apart in the same manner the jaws of a set of pliers would spread apart; the bottom portion will spread apart less than the top portion as the jaws are opened.

The insert 200 with insert sections 224 is designed to flex with the strikeface 110 when a ball is struck and to minimize the dissipation of the energy imparted by the impact with the golf ball. However, some impact energy is still lost in the insert 200. Therefore, the insert 200 also serves to reinforce the strikeface 110 to some extent. The strikeface 110 comprises a strikeface thickness 119 measured between the strikeface front surface 117 and the strikeface rear surface 118. The strikeface thickness 119 contributes to the durability of the strikeface 110 under impact. The impact energy that is absorbed by the insert 200 allows the strikeface thickness 119 to be smaller than it could be while remaining sufficiently durable without the insert 200 attached to the strikeface rear surface 118.

A first and second embodiment of the back cavity insert disclosed within are presented below. However, the claimed back cavity insert is not limited to the first and second embodiments disclosed. Other back cavity insert configurations are disclosed in the discussion of general insert structure and general insert function. These may include, but are not limited to, back cavity inserts having a different number of insert sections, different insert section shapes, and any combination of the attribute ranges disclosed herein.

C) First Embodiment of the Back Cavity Insert

Referring to FIGS. 6-9, the back cavity insert 300 adhesive layer 304 may comprise a VHB tape wherein an elastomeric layer 310 comprises a plurality of flexible polymeric or rubber portions that are affixed to the VHB tape, and the cap 320 is comprised of a plurality of metallic outer portions affixed to each of the plurality of elastomeric layer 310 portions. In this first embodiment, the plurality of elastomeric layer 310 flexible portions paired with the metallic cap 320 outer portions form a plurality of individual insert sections 324. The individual insert sections 324 are arranged on the adhesive layer 304 VHB tape such that they have gaps 340 between each of the individual insert sections and such that the adhesive layer 304 VHB tape is visible through the gaps 340 (as explained in more detail above).

Referring to FIGS. 6-9, the first embodiment of the insert comprises seven distinct individual insert sections 324. Each of the seven elastomeric layer 310 polymeric material portions is adhesively affixed to both the adhesive layer 304 VHB tape and to a metallic cap 320 metallic outer material portion.

Referring to FIGS. 6-9, each of the seven distinct individual sections comprises a multi-sided shape, such that the sides of each section adjacent to another individual section are straight and parallel to the sides of the adjacent piece or section. The insert 300 further comprises two heel-side insert sections (one upper heel-side section 351 and one lower heel-side section 352), two toe-side compound sections (one upper toe-side section 353 and one lower toe-side section 354), and three central compound sections (an upper central section 355, a lower, heel-side central section 356, and a lower, toe-side central section 357).

The upper heel-side section 351 is adjacent to the top rail, the lower heel-side section 352, the upper central section 355, and the lower, heel-side central section 356. The lower heel-side section 352 is adjacent the upper heel-side section 351, and the lower, heel-side central section 356. The upper toe-side section 353 is adjacent to the top rail, the lower toe-side section 354, the upper central section 355, and the lower, toe-side central section 357. The lower toe-side section 354 is adjacent the upper toe-side section 353, and the lower, toe-side central section 357. The upper central section 355, lower, heel-side central section 356, and lower, toe-side central section 357 are all adjacent to each other such that each central section has a side parallel to each of the other two central sections. Further, the upper central section 355, lower, heel-side central section 356, and lower, toe-side central section 357 form an intersection wherein one corner or vertex of each of the central sections are all adjacent at an insert center 358. The insert 300 is oriented in the back cavity 116 such that the insert center 358 is located on the strikeface rear surface 118 approximately opposite a strikeface geometric center 140. The three central sections completely surround the insert center 358, such that each shared corner of the three central sections defines an approximately 120-degree angle with the two intersecting central section walls at that corner.

Referring to FIGS. 6-9, the upper heel-side section 351, upper toe-side section 353, upper central section 355, lower toe-side section 354, and lower heel-side section 352 each have one or more sides adjacent to the inner perimeter of the rearward projection. The one or more sides of each section adjacent to the inner perimeter of the rearward projection may be straight or may be curved to follow the shape of the inner perimeter of the rearward projection.

D) Second Embodiment of the Back Cavity Insert

Referring to FIGS. 10-13, the iron-type golf club head 100 comprises a multi-component insert 400 insert to help increase ball speed and launch angle. The multi-component insert 400 allows for gaps 440 between the insert sections 424 to minimize the insert's influence on strikeface flexing. Described below is a second embodiment of a multi-component insert 400.

Referring to FIGS. 10-13, the back cavity insert 400 can be formed from an adhesive layer 404 comprising a foam-based very high bond tape (i.e., VHB), an elastomeric layer 410 comprising a plurality of flexible polymeric portions 412*v* (e.g., ABS plastic with Shore D hardness ranging from 70 to 100), and a cap 420 comprising a plurality of metallic outer portions 422 (e.g., aluminum). The elastomeric layer 410 plurality of flexible polymeric portions 412 are affixed to the adhesive layer 404 VHB tape, and cap 420 plurality of metallic outer portions 422 are affixed to elastomeric layer 410 plurality of flexible polymeric portions 412. The combination of elastomeric layer 410 plurality of flexible polymeric portions 412 and the cap 420 plurality of metallic outer portions 422 form a plurality of insert sections 424. The insert sections 424 are arranged on the elastomeric layer 410 VHB tape such that they have gaps 440 between each of the insert sections 424 as described above. The adhesive layer 404 VHB tape can be visible through the gaps 440. The insert 400 is affixed to the strikeface rear surface 118.

Referring to FIGS. 10-13, the insert 400 can comprise four insert sections 424. Each of the four insert sections 424 comprises a multi-sided shape, such that the sides or edges between adjacent insert sections are curvilinear, curved, arcuate, or rounded. The edges of the insert sections 424 converge, merge, or connect at or near the geometric center 140 of the strikeface 110. The insert section 424 edges converge to a center gap 441 that is adjacent or located near the strikeface geometric center 140. As described in more detail below, the center gap 441 can improve the flexing of the strikeface during a golf ball impact.

Referring to FIGS. 10-13, the insert 400 comprises a heel side section 451, a toe side section 452, a top section 453, and a bottom section 454. The heel side section 450 is adjacent to the heel portion 108, the toe side section 452 is adjacent to the toe portion 104, the top section 453 is adjacent to the top portion 104, and the bottom section 454 is adjacent to the bottom portion 101. The heel side section 451 can be adjacent to the heel portion 108, the top section 453, and the bottom section 454. The toe side section 452 can be adjacent to the toe portion 104, the top section 453, and the bottom section 454. The top section 453 can be adjacent to the top portion 104, the heel side section 451, and the toe side section 452. The bottom section 454 can be adjacent to the bottom portion 101, the heel side section 451, and the toe side section 452. Each of the sections 424 comprise at least one curvilinear edge, wherein an adjacent section edge has a complimentary curve.

Further, the heel side section 451, the toe side section 452, the top section 453, and the bottom section 454 form an intersection wherein one corner, vertex, or edge of each of the sections can be adjacent to the geometric center 140 of the strikeface 110. The heel side section 451, the toe side section 452, the top section 453, and the bottom section 454 form a center gap 441 adjacent to the geometric center 140 of the strikeface 110. Wherein a corner, vertex, or edge of each of the sections 424 forms a perimeter of the center gap 441. Referring to FIGS. 10-13 illustrate the sections 424 forming the center gap 441 and the gap perimeter. In particular, a curved edge of the top section 453, a curved edge of the bottom section 454, a vertex of the heel side section 451, and a vertex of the toe side section 452 form the center gap 441 and the perimeter of the gap.

Referring to FIGS. 10-13, the insert 400 comprising multiple sections is assembled with the iron-type golf club head 100 by affixing the insert 400 to the strikeface rear surface 118. The strikeface 110 flexes rearward when the iron-type golf club head strikes a golf ball. As the strikeface 110 flexes rearward, the adhesive layer 404 also flexes rearward, curving to match the rearward flexing of the strikeface 110. As the adhesive layer 404 flexes rearward at impact, the gaps 440 between insert sections 424 allows the sections to spread apart (instead of being put into tension), increasing the gap width 442 up to 0.010 inch between the insert sections 424. In this second embodiment, the insert 400 does not resist the flexing of the strikeface 110. As the strikeface 110 rebounds, the adhesive layer 404 returns to its flatter, original shape, and the insert sections 424 are returned to their original configuration having smaller gaps 440 having a gap width as discussed below.

Still referring to FIGS. 10-13, the gap width 442 prior to a golf ball impact can be smaller or less than the gap width 442 during the golf ball impact. The gap width 442 increases due to the strikeface 110 flexing under the force of the golf ball, wherein the strikeface 110 bends and the insert 400 bends. The gaps 440 between the sections prior to impact with a golf ball comprise a gap width that ranges from 0.005 inch to 0.040 inch. For example, the gap width 442 prior to impact can be 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021 inch, 0.022 inch, 0.023 inch, 0.024 inch, 0.025 inch, 0.026 inch, 0.027 inch, 0.028 inch, 0.029 inch, 0.030 inch, 0.031 inch, 0.032 inch, 0.033 inch, 0.034 inch, 0.035 inch, 0.036 inch, 0.037 inch, 0.038 inch, 0.039 inch, or 0.040 inch. During the impact flexing of the strike face, the width of the gaps between the sections can increase up to 0.010 inch, and ranges from 0.015 to 0.050 inch, depending on the location of the gap on the insert. For example, the gap width during the golf ball impact can be 0.015 inch, 0.016 inch, 0.017 inch, 0.018 inch, 0.019 inch, 0.020 inch, 0.021 inch, 0.022 inch, 0.023 inch, 0.024 inch, 0.025 inch, 0.026 inch, 0.027 inch, 0.028 inch, 0.029 inch, 0.030 inch, 0.031 inch, 0.032 inch, 0.033 inch, 0.034 inch, 0.035 inch, 0.036 inch, 0.037 inch, 0.038 inch, 0.039 inch, 0.040 inch, 0.041 inch, 0.042 inch, 0.043 inch, 0.044 inch, 0.045 inch, 0.046 inch, 0.047 inch, 0.048 inch, 0.049 inch, or 0.050 inch. Gaps 440 between insert sections 424 closer to the strikeface geometric center 140 will increase in width to a larger extent than gaps 440 further from the strikeface geometric center 140.

Example 1

Referring to FIGS. 14A-14E, a comparison was conducted of two inserts. The first insert was the flexible insert 300 described in the first embodiment above. The second (control) insert was exactly identical to the first insert 300, except lacking the gaps creating separate sections or panels. The first embodiment insert 300 with a plurality of insert sections 324 having gaps 340 between them showed improved performance (as discussed below) over the identical comparison insert (in the control club) that had continuous, unbroken adhesive, elastomeric, and cap layers. Both were placed in identical 7-iron golf club heads having a loft of 29 degrees. The test incorporated player testing, robotic testing, and FEA simulation. The player test had 20 players each hitting ten shots with each of the two golf 7-iron golf clubs. The robotic testing had the robot hitting the golf ball for 5 shots at each or 9 different face positions for each of the two 7-iron golf clubs. For each hit, the initial ball speed, ball spin, launch angle, distance traveled, and maximum trajectory height was measured. The data referred to in this example is drawn from all of the above tests.

Figure 14A:
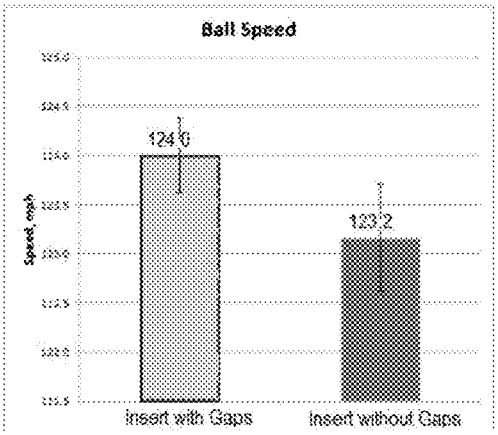
FIGS. 14A-14E are charts of Example 1 comparative test results.
Figure 14B:
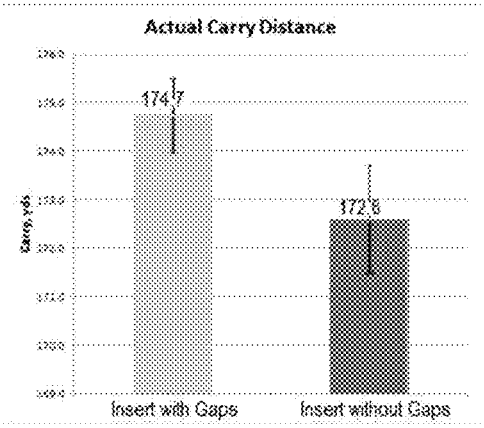
Figure 14C:
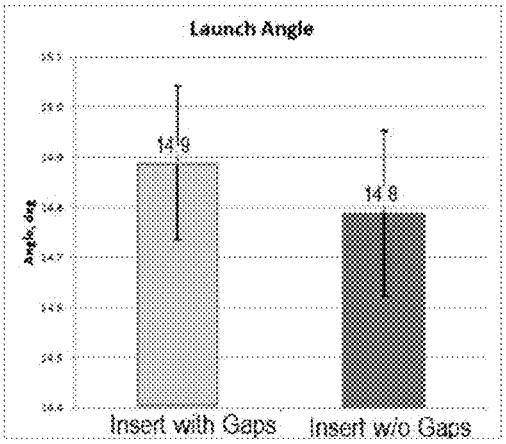
Figure 14D:
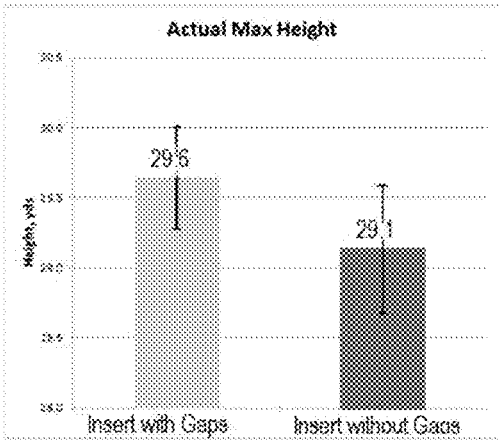
Figure 14E:
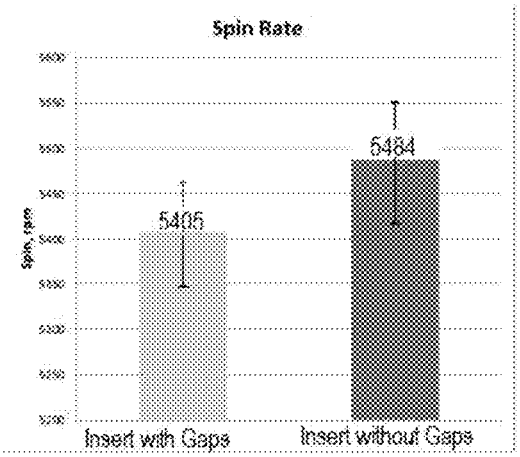

The iron-type golf club head and insert design were identical between the flexible (with gaps) and stiff (without gaps) inserts, except that the flexible insert 300 had the gaps 340 and insert sections 324 as described in the first insert 300 embodiment. Referring to FIG. 14A, the iron-type golf club head having flexible insert 300 comprising the gaps 340 and insert sections 324 provided an almost 1 mile per hour higher initial ball speed than the iron-type golf club head comprising the insert without gaps. The additional ball speed upon impact results from less energy lost during the ball impact due to the flexibility provided by the insert gaps. Referring to FIG. 14B, the iron-type golf club head having flexible insert 300 comprising the gaps 340 and insert sections 324 provided a 2-yard additional carry distance. Referring to FIGS. 14C and 14D, the iron-type golf club head having flexible insert 300 comprising the gaps 340 and insert sections 324 provided a marginally higher launch angle and maximum height. Referring to FIG. 14E, the iron-type golf club head having flexible insert 300 comprising the gaps 340 and insert sections 324 provided an almost 80 rpm lower spin rate. The 7-iron golf clubs tested in this Example 1 were similar in construction except for the gaps in the back cavity insert applied only to one of the 7-irons. The 7-iron having an insert with gaps had the surprising result of improved average carry distance, which was only attributable to the gaps provided in the back cavity insert applied to this 7-iron.

In summary, the Example 1 iron-type golf club having an iron-type golf club head comprising the flexible insert 300 comprising the gaps 340 and insert sections 324 only differed from the control iron-type golf club head back cavity insert in having the insert with gaps 340. All other factors were controlled to be identical. In this Example 1, the improved flight characteristics of higher launch angle, maximum ball flight height, greater ball speed, and lower launch spin rates cooperated to provide a 2-yard carry distance improvement.

As the rules to golf may change from time to time (e.g., new regulations may be adopted, or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Replacement of one or more claimed elements constitutes reconstruction and not repair. Additionally, benefits, other advantages, and solutions to problems have been described regarding specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An iron-type golf club head comprising:

an iron-type golf club head body and an insert;

the iron-type golf club head body comprising:

a front portion and a back portion, a top portion comprising a top rail, and a bottom portion comprising a sole;

a strikeface comprising a strikeface front surface located at the front portion and a strikeface rear surface located opposite the strikeface front surface towards the back portion;

the strikeface further comprises a strikeface geometric center, a strikeface perimeter; and a thickness measured from the strikeface front surface to the strikeface rear surface;

wherein a rear perimeter extension extends rearwardly from the strikeface perimeter;

wherein the strikeface rear surface and the rear perimeter extension cooperate to define a back cavity;

an insert comprising:

an adhesive layer, an elastomeric layer, and a cap;

wherein the insert is configured to be received within the back cavity and adhesively attached to the strikeface rear surface;

wherein the adhesive layer consists of a single, unbroken piece;

wherein the elastomeric layer comprises a first plurality of portions, and the cap comprises a second plurality of portions;

wherein the elastomeric layer first plurality of portions are aligned with the cap second plurality of portions;

wherein one elastomeric layer portion and one cap portion form an insert section such that each of the plurality of elastomeric layer portions is paired with a different cap portion, and such that each of the plurality of cap portions is paired with an individual elastomeric core portion such that the insert comprises a third plurality of insert sections;

wherein the third plurality of insert sections are separated one from another by gaps such that none of the third plurality of sections are directly connected one to another;

wherein the gaps are defined by uncovered areas of the adhesive layer.

2. The iron-type golf club head of claim 1 wherein the insert further comprises a maximum insert length measured in a toe portion to heel portion direction and a maximum insert height measured in a bottom portion to top portion direction;

wherein the maximum insert length is in a range of 2.80 inches to 3.00 inches; and wherein the maximum insert height is in a range of 1.20 inches to 1.30 inches.

3. The iron-type golf club head of claim 1, wherein each of the insert sections is affixed to the adhesive layer.

4. The iron-type golf club head of claim 1, wherein insert further comprises a gap width that comprises a minimum gap width in a rest state and a maximum gap width in an expanded state when strikeface flexes rearward as the iron-type golf club head strikes a golf ball.

5. The iron-type golf club head of claim 4, wherein a minimum gap width is in a range of 0.005 inch to 0.010 inch.

6. The iron-type golf club head of claim 5, wherein when the golf club head strikes a golf ball, the strikeface is rearwardly flexibly displaced; and wherein when the strikeface is rearwardly flexibly displaced, the adhesively attached insert is also flexibly displaced by the strikeface rear surface, increasing the gap width;

wherein the maximum gap width is up to 0.010 inch greater than the minimum gap width.

7. The iron-type golf club head of claim 1, wherein the plurality of sections comprise seven sections.

8. The iron-type golf club head of claim 7, wherein the seven sections further comprise two toeward sections, three central sections, and two heelward sections.

9. The iron-type golf club head of claim 8, wherein the two toeward sections comprise a top toeward section and a bottom toeward section;

the two heelward sections comprise a top heelward section and a bottom heelward section; and wherein the three central sections comprise a top central section, a bottom, heelward central section, and a bottom, toeward central section.

10. The iron-type golf club head of claim 9, wherein the two heelward sections are adjacent to the central top section and the bottom heelward central section, and wherein the two toeward sections are adjacent to the central top section and the bottom, toeward central section.

11. The iron-type golf club head of claim 1, wherein the adhesive layer is formed from a foam-based, very high bond (VHB) tape.

12. The iron-type golf club head of claim 1, wherein the elastomeric layer portions comprise a Shore D hardness ranging from 70 to 100.

13. The iron-type golf club head of claim 1, wherein the cap portions are metallic.

14. The iron-type golf club head of claim 1, wherein the elastomeric layer comprises a flexible polymeric or rubber material.

15. An iron-type golf club head comprising:

an iron-type golf club head body and an insert;

the iron-type golf club head body comprising:

a front portion and a back portion, a top portion comprising a top rail, and a bottom portion comprising a sole;

a strikeface comprising a strikeface front surface located at the front portion and a strikeface rear surface located opposite the strikeface front surface towards the back portion;

the strikeface further comprises a strikeface geometric center, a strikeface perimeter; and a thickness measured from the strikeface front surface to the strikeface rear surface;

wherein a rear perimeter extension extends rearwardly from the strikeface perimeter;

wherein the strikeface rear surface and the rear perimeter extension cooperate to define a back cavity;

an insert comprising:

an adhesive layer and a cap;

wherein the insert is configured to be received within the back cavity and adhesively attached to the strikeface rear surface;

wherein the adhesive layer consists of a unitary, continuous piece;

wherein the cap comprises a plurality of portions;

wherein the plurality of cap portions are separated one from another by gaps such that the plurality of portions is not directly connected one to another;

wherein the gaps are defined by uncovered areas of the adhesive layer.

16. The iron-type golf club head of claim 15, wherein insert further comprises a gap width that comprises a minimum gap width in a rest state and a maximum gap width in an expanded state when strikeface flexes rearward as the iron-type golf club head strikes a golf ball.

17. The iron-type golf club head of claim 16, wherein a minimum gap width is in a range of 0.005 inch to 0.010 inch.

18. The iron-type golf club head of claim 17, wherein when the golf club head strikes a golf ball, the strikeface is rearwardly flexibly displaced; and wherein when the strikeface is rearwardly flexibly displaced, the adhesively attached insert is also flexibly displaced by the strikeface rear surface, increasing the gap width;

wherein the maximum gap width is up to 0.010 inch greater than the minimum gap width.

19. The iron-type golf club head of claim 15, wherein the plurality of cap portions comprises four cap portions.

20. The iron-type golf club head of claim 19, wherein the plurality of cap portions comprise a top cap portion, a toe cap portion, a bottom cap portion, and a heel cap portion.

* * * * *